United States Patent [19]

Mollon et al.

[11] Patent Number: 4,751,021

[45] Date of Patent: Jun. 14, 1988

[54] BENDABLE SHEET MATERIAL

[75] Inventors: Leslie Mollon, Southfield; Robert H. Stamm, Canton, both of Mich.

[73] Assignee: AAR Corporation, Elk Grove Village, Ill.

[21] Appl. No.: 814,803

[22] Filed: Dec. 30, 1985

[51] Int. Cl.[4] ..... G21F 1/12

[52] U.S. Cl. ..... 252/478; 250/518.1; 250/519.1; 376/287; 376/288

[58] Field of Search ..... 250/515.1, 517.1, 518.1, 250/519.1; 252/478, 633; 376/272, 287, 288, 327, 333, 339; 419/17, 50

[56] References Cited

U.S. PATENT DOCUMENTS

| | | | |
|---|---|---|---|
| 2,928,948 | 3/1960 | Silversher | 250/515.1 |
| 3,165,448 | 1/1965 | McCorkle et al. | 376/287 |
| 3,434,925 | 3/1969 | Montagnani et al. | 376/288 |
| 3,751,336 | 8/1973 | Angelini et al. | 376/327 |
| 4,006,362 | 2/1977 | Mollon et al. | 376/272 |
| 4,027,377 | 6/1977 | Roszler | 419/50 |
| 4,143,276 | 3/1979 | Mollon | 376/272 |
| 4,453,081 | 6/1984 | Christ et al. | 250/515.1 |

FOREIGN PATENT DOCUMENTS

| | | | |
|---|---|---|---|
| 593167 | 2/1960 | Canada | 376/327 |
| 697145 | 11/1964 | Canada | 250/519.1 |
| 127241 | 12/1984 | European Pat. Off. | 250/515.1 |
| 1236808 | 6/1971 | United Kingdom | 376/287 |

OTHER PUBLICATIONS

Nuclear Power, Aluminum Based Materials for Shielding, Jun. 1960, p. 117.

*Primary Examiner*—Deborah L. Kyle
*Assistant Examiner*—Richard W. Wendtland
*Attorney, Agent, or Firm*—Barnes, Kisselle, Raisch, Choate, Whittemore & Hulbert

[57] ABSTRACT

A neutron absorbing panel has improved resistance to loss of efficiency resulting from bending about an axis located at a designated side of the panel. The panel comprises a core of substantially uniform thickness formed of a sintered mixture of particles of neutron absorbing material such as boron carbide ($B_4C$) and metal such as aluminum. Metal cladding sheets are provided at both sides of the core, and aluminum is the preferred metal for both the metal core particles, and cladding. The sintered core lacks the ductility of the outer cladding sheets, and to improve bendability, the thickness of one cladding sheet is materially greater than the other. Bending of the improved panel about an axis spaced outwardly from the side thereof having the thinner cladding sheet leaves the outer surface of the panel at the bend smoother than when the cladding sheets are of uniform thickness, and substantially uniform neutron absorbing ability is retained.

8 Claims, 1 Drawing Sheet

BENDABLE SHEET MATERIAL

BACKGROUND AND SUMMARY OF THE PRESENT INVENTION

The present invention relates to a bendable sheet material having a sintered core provided at both sides with duefile cladding sheets bonded to the core, and exemplified by a neutron absorbing panel which is an improvement over prior U.S. Pat. No. 4,027,377.

The prior patent discloses a panel having a core composed of a sintered mixture of particles of a neutron absorbing material such as boron carbide ($B_4C$) and aluminum having cladding sheets of metal, such as aluminum at opposite sides. The cladding sheets are of uniform thickness so that the core is centered with respect to the median plane of the panel.

Panels of this construction may be assembled into enclosures for neutron emitting material, as disclosed for example in prior U.S. Pat. No. 4,006,362, but it is desirable in some cases to bend the panels to form rounded corners connecting flat panel sections, or bending a flat strip into a tube.

Since the core material lacks the ductility of the cladding sheaths, bending a flat panel or strip into curved or arcuate form has resulted in disturbance of the integrity of the neutron absorbing core.

In protective sheet material of the type disclosed here, it is essential that the neutron absorbing core is uniformly effective to minimize or prevent escape of harmful or lethal neutrons. Accordingly, any disturbance of the core in the bent zone which results in areas of reduced neutron absorbing effectiveness is a serious defect.

It has been found that such disturbance of the neutron absorbing core by bending is reduced by providing a cladding sheet at the side of the panel which is remote from the axis of the bend which has a thickness greater than that of the cladding sheet at the other side of the panel. The result is that the core is displaced from the central or median plane of the panel. The central plane of the panel may be considered as the neutral plane in the bending step, with the result that the material of the panel at the side of the neutral plane adjacent the bending axis is under compression, while the material at the other side of the neutral plane is under tension and is stretched or elongated as a result at the bending step. The cladding sheet, such as aluminum a is ductile, and is progressively stretched or elongated and correspondingly thinned at the side of the neutral plane remote from the axis of the bend. The core material lacking the ductility of the cladding material, tends to be cracked or fissured at the side of the neutral plane remote from the axis of bending.

On the other hand, the core material at the side of the neutral plane adjacent the axis of bending is subjected to compressive forces which it can accommodate without loss of integrity, so far as its neutron absorbing capability is concerned.

COMPLETE DESCRIPTION

The prior art panel as disclosed in U.S. Pat. No. 4,027,377 comprises a central neutron absorbing core 10 which is composed of sintered particles of a neutron absorbing material such as boron carbide ($B_4C$) and a metal such as aluminum. The core is sintered at a temperature below the melting point of the metal, resulting in a self-sustaining mass.

At opposite sides of the core are metal cladding sheets 12 and 14, which may be aluminum. In producing these panels as disclosed in U.S. Pat. No. 4,027,377, an assembly of metal sheets with the mixture of metal particles and particles of a neutron absorbing material therebetween is brought to a temperature slightly less than the melting point of the metal particles, and then rolled to reduce the thickness of the assembly to that required of the panel. This rolling operation results in sintering the particles of neutron absorbing material and metal into a coherent mass, and in providing a molecular bond between the core and the inner surfaces of the cladding sheets. The thickness of the cladding was the same at both sides of the panel.

Figure 2:
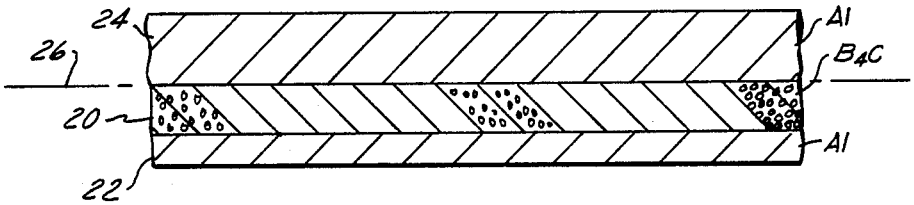
PRIOR ART FIG. 2
FIG. 2 is a sectional view through the improved panel.

In accordance with the improvement disclosed herein the thickness of the cladding at one side of the panel is materially greater than at the other, to improve the ability of the panel to be bent to a relatively small radius about an axis at the side of the panel remote from the thicker cladding. In FIG. 2, there is illustrated a relationship between core and cladding embodying the present invention. Here a neutron absorbing core 20 is provided at one side with a cladding sheet or cover 22 which as shown is relatively thin. At the other side, the panel has a cladding sheath or cover 24 which is relatively thick as compared to cover 22. The median plane of the panel of FIG. 2, an extension of which is designated 26, is located such that the core 20 is located in its entirety at one side of the median plane 26.

Figure 1:
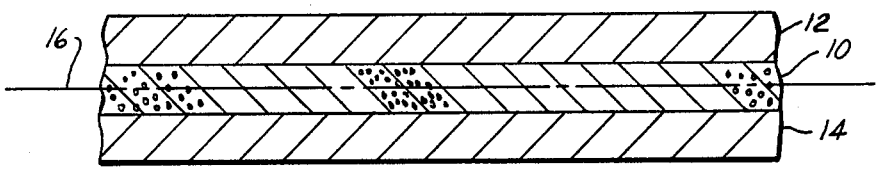
FIG. 1 is a sectional view of the prior art panel.

This is to be contrasted with the prior art panel of FIG. 1, where the median plane 16 of the panel is also the median plane of the core 10.

Figure 3:
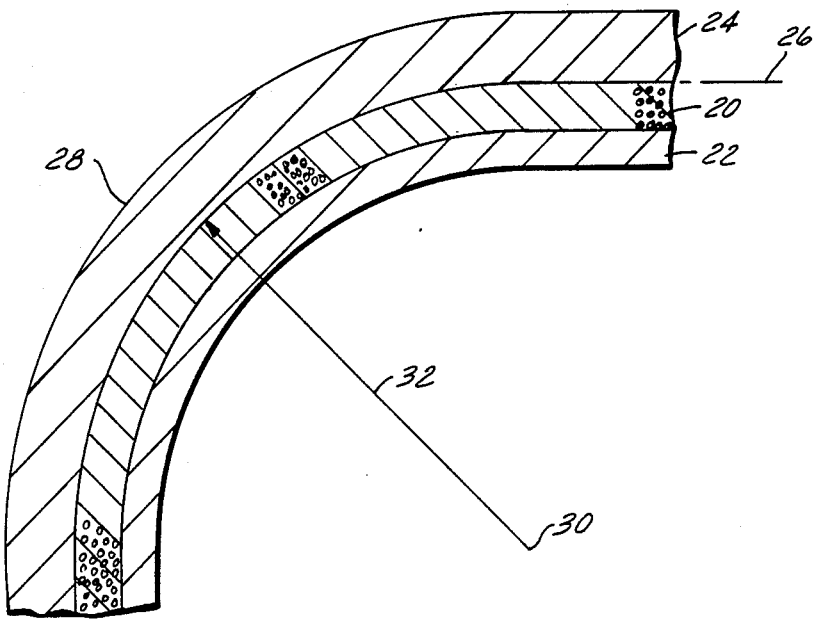
FIG. 3 is a diagrammatic view, on a smaller scale, of a panel having a 90° bend therein.

In FIG. 3, there is shown an arcuate bend 28 about an axis 30, the arrow 32 representing the approximate location of the median or neutral plane 26 in the zone of the bend. It is to be observed that the location of the bending axis is at the side of the panel having the thinner cladding sheet 22. Since the portion of the panel lying beyond the median plane 26 is elongated progressively from the median plane to the outer surface of sheet 24, the material of the sheet 24 within the bent zone is stretched or elongated with a corresponding thinning of the material, although this is not shown in the Figure. This is accommodated since the metal of the sheet is ductile.

On the other hand, the core 20 as well as the sheet 22 is subject to compression in the bent zone. The core material lacks the ductility of the aluminum sheets 22, 24, but is well able to withstand the pressure which is developed by the bending. Again, this will be accompanied by some compression of the core material, and a thickening of the core material and sheet 22 in the bending zone which again is not illustrated in diagrammatic FIG. 3. However, the core material does not lose its neutron absorbing integrity due to the formation of cracks or fissures which would result in irregular local thinning of the neutron absorbing material permitting neutron penetration.

The foregoing represents an extreme case in which the core in its entirety lies at one side of the neutral or median plane. However, it will be apparent that displacement of the core laterally toward one side of the panel enhances its ability to withstand bending about an axis at the said one side of the panel.

In an example, a panel was produced as disclosed in U.S. Pat. No. 4,027,377, having an overall thickness of 0.088 inches. The core thickness was 0.022 inches, and the cladding sheets were 0.022 inches and 0.042 inches. With these dimensions it will be noted that the median plane of the panel substantially coincides with the side of the core adjacent the thicker cladding sheet. This panel was bent to form an arcuate bend by bending about an axis spaced from the adjacent surface of the thinner cladding sheet by about $\frac{3}{8}$ inches, and the outer surface of the bent zone remained smooth and evenly curved indicating no cracking or fissuring of the core material.

It will be noted that if the panel material as described above was an elongated strip, and if the bending axis was parallel to the length of the strip, the strip could be bent to form a tube of circular cross-section.

It will further be noted that in the specific example given above, substantially the entire thickness of the core lies at one side of the central plane of the panel. This is a limiting case, but it is to be understood that any displacement of the core laterally of the central plane of the panel improves the ability of the panel to be bent into curved configuration about a center line of curvature located at the side of the panel having the thinner cladding sheet, or, in other words, at the side of the panel toward which the center plane of the core is displaced from the central plane of the panel.

As disclosed in U.S. Pat. No. 4,027,377, the sintered particles of the core are very small, as an atomized aluminum, and a fine powder produced from solid boron carbide.

While the specific example disclosed herein is a neutron absorbing panel having a core of sintered particles of boron carbide and aluminum with aluminum cladding sheets molecularly bonded to opposite sides of the core, it will of course be apparent that the invention is applicable to any laminated sheet material comprising a core of sintered particles in which the core has limited ductility because of limited ductility of at least some of the particles, and cladding sheets positively bonded to opposite sides of the core, in which the cladding sheets are of materially different thickness and are of substantially greater ductility than the sintered core.

What is claimed is:

1. Neutron absorbing sheet material characterized by improved retention of its neutron absorbing ability in a curved zone when bent into a substantially curved cross-section about a center of curvature located at and spaced from a first side of said sheet material as compared to being bent about a center of curvature located at and spaced equally from the other side of said sheet material, said material comprising a neutron absorbing core composed of sintered particles of a neutron absorbing material and a metal, said core being of substantially uniform thickness having a first side adjacent the first side of said sheet material, a first metal cladding sheet of substantially uniform thickness molecularly bonded to said first side of said core, a second metal cladding sheet of substantially uniform thickness molecularly bonded to the other side of said core, said core having substantially less ductility than said cladding sheets and being subject to cracking and/or fissuring when stretched, said first cladding sheet having a thickness substantially less than the thickness of said core and said second cladding sheet having a thickness substantially greater than the thickness of said core so that the central plane of said core is displaced from the central plane of said sheet material toward said first side of said sheet material and toward said relatively thin cladding sheet, to retain more uniform and effective neutron absorption in the curved area when bent into a curved configuration about a center of curvature located at and spaced from said first side of said sheet material as compared to bending about a center of curvature at and spaced equally from the other side of said sheet material, and also as compared to a correspondingly bent sheet material having an identical core and cladding sheets of thicknesses equal to each other.

2. Neutron absorbing sheet material as defined in claim 1, wherein said neutron absorbing particles in said core are boron carbide ($B_4C$).

3. Neutron absorbing sheet material as defined in claim 2, wherein said sheet metal particles and said metal cladding sheets are aluminum.

4. Neutron absorbing sheet material as defined in claim 3, wherein said sheet material comprises at least a portion bent into a curved configuration about a center of curvature located at and spaced from the side of said sheet material having said first relatively thin cladding sheet.

5. Neutron absorbing sheet material as defined in claim 2, wherein said core is located in its entirety at the side of the central plane of said sheet material toward said first side of said sheet material and toward said first relatively thin cladding sheet.

6. Bendable laminated sheet material characterized by improved retention of its integrity in a curved zone when bent into a curved configuration about a center of curvature located at and spaced from a first side of said sheet material as compared to being bent about a center of curvature located at and spaced equally from the other side of said sheet material, said material comprising a core of substantially uniform thickness having a first side adjacent to said first side of said sheet material, a first cladding sheet of substantially uniform thickness permanently bonded to said first side of said core, and a second cladding sheet of substantially uniform thickness permanently bonded to the other side of said core, said core having substantially less ductility when said cladding sheets and being subject to cracking and/or fissuring when stretched, said first cladding sheet having a thickness substantially less than the thickness of said core and said second cladding sheet having a thickness substantially greater than the thickness of said core so that the central plane of said core is displaced from the central plane of said sheet material towards said first side of said sheet material and towards said first relatively thin cladding sheet, to retain the integrity of said sheet material more effectively and uniformly when bent into a curved configuration about a center of curvature located at and spaced from said first side of said sheet material as compared to bending about a center of curvature at and equally spaced from the other side of said sheet material, and also as compared to a correspondingly bent sheet material having an identical core and cladding sheets of thicknesses equal to each other.

7. Bendable laminated sheet material as defined in claim 6, wherein said sheets are metal and are molecularly bonded to said core.

8. Bendable laminated sheet material as defined in claim 6, wherein said core is composed of sintered particles of a neutron absorbing material and a metal.

* * * * *